US010538102B2

(12) United States Patent
Stöckle et al.

(10) Patent No.: US 10,538,102 B2
(45) Date of Patent: Jan. 21, 2020

(54) METHOD AND EVALUATOR FOR DETERMINING THE STATE OF A DEGASSING DEVICE

(71) Applicant: Océ Holding B.V., Venlo (NL)

(72) Inventors: Ulrich Stöckle, Munich (DE); Stefan Adelsperger, Walpertskirchen (DE)

(73) Assignee: Océ Holding B.V., Venlo (NL)

( * ) Notice: Subject to any disclaimer, the term of this patent is extended or adjusted under 35 U.S.C. 154(b) by 0 days.

(21) Appl. No.: 16/191,903

(22) Filed: Nov. 15, 2018

(65) Prior Publication Data

US 2019/0143708 A1 May 16, 2019

(30) Foreign Application Priority Data

Nov. 16, 2017 (DE) ..... 10 2017 126 982

(51) Int. Cl.
*B41J 2/19* (2006.01)
*B41J 2/175* (2006.01)

(52) U.S. Cl.
CPC ..... *B41J 2/19* (2013.01); *B41J 2/17563* (2013.01)

(58) Field of Classification Search
CPC ..... B41J 2/19; B41J 2/17563
See application file for complete search history.

(56) References Cited

U.S. PATENT DOCUMENTS 8,529,029 B2 9/2013 Szusdziara et al.
10,252,524 B1 * 4/2019 Slotto ..... B41J 2/175
2010/0245435 A1 9/2010 Nakamura
2013/0242006 A1 * 9/2013 Anno ..... B01D 19/0031 347/85
2014/0238944 A1 * 8/2014 Shinkai ..... B41J 2/17563 210/806
2015/0085033 A1 * 3/2015 Ando ..... B41J 2/19 347/92
2017/0001434 A1 * 1/2017 Makita ..... B41J 2/04508
2017/0239956 A1 * 8/2017 Karita ..... B41J 2/175
2018/0009229 A1 * 1/2018 Venner ..... B41J 2/14233
2018/0009231 A1 * 1/2018 Yokozawa ..... B41J 2/175
2018/0093491 A1 * 4/2018 Murayama ..... B05B 15/40
2019/0263134 A1 * 8/2019 Hiramoto ..... B41J 2/17563

FOREIGN PATENT DOCUMENTS

DE 102010061001 A1 6/2012
JP 2007229977 A 9/2007

OTHER PUBLICATIONS

German action dated Jul. 13, 2018—Application No. 10 2017 126 982.7.

* cited by examiner

*Primary Examiner* — Julian D Huffman
(74) *Attorney, Agent, or Firm* — Schiff Hardin LLP

(57) ABSTRACT

A degassing device can include one or more passive components, such as a gas-permeable membrane. The passive components may not directly be monitored. The state (e.g. the permeability) of the passive components may be reliably determined via evaluation of pressure information with regard to the pressure (e.g. negative pressure) in the degassing device.

15 Claims, 3 Drawing Sheets

METHOD AND EVALUATOR FOR DETERMINING THE STATE OF A DEGASSING DEVICE

CROSS REFERENCE TO RELATED APPLICATIONS

This patent application claims priority to German Patent Application No. 102017126982.7, filed Nov. 16, 2017, which is incorporated herein by reference in its entirety.

BACKGROUND

The disclosure relates to a degassing device and a method for determining the state of a degassing device of an inkjet printer.

An inkjet printer for printing to a recording medium comprises one or more print heads having respectively one or more nozzles. The nozzles are respectively set up to eject ink droplets in order to print dots of a print image onto the recording medium. The ink used in a print head may thereby be degassed in advance within a degassing device, in particular with a degassing cartridge, in order to reduce the gas content in the ink and in order to thereby reduce the risk of nozzle failures due to gas inclusions.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 4A:
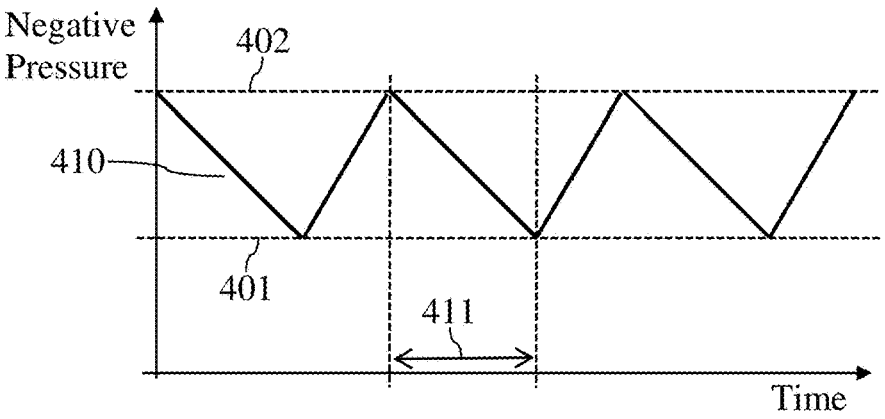
Figure 4B:
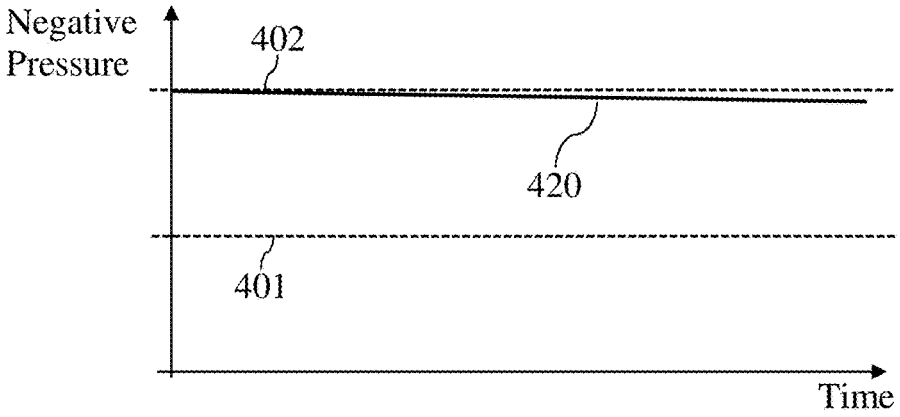
Figure 5:
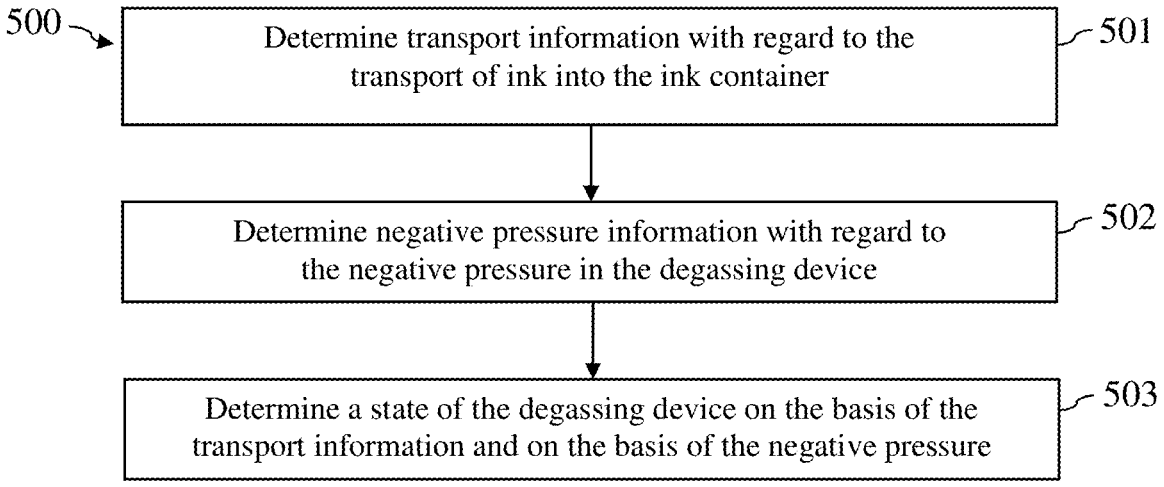

FIG. 4*a*-4*b* illustrate examples of time curves of the negative pressure in a degassing device according to an exemplary embodiment of the present disclosure; and FIG. 5 illustrates a flowchart of a method for determining the state of a degassing device according to an exemplary embodiment of the present disclosure.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the present disclosure includes determining the state of a degassing device (e.g. degasser) in an efficient and reliable manner.

According to one aspect of the disclosure, a method is described for determining the state of a degassing device. To degas ink, ink is transported from a container through the degassing device and back again into the container. Within the degassing device, gas may be then be extracted from the ink. Furthermore, ink is supplied from the container to one or more print heads of an inkjet printer. Furthermore, new ink may be transported into the container depending on the ink consumption of the one or more print heads.

In an exemplary embodiment of the disclosure, the method includes the determination of transport information with regard to the transport of new ink into the container. Moreover, the method includes the determination of negative pressure information with regard to a negative pressure produced in the degassing device to degas ink. The method also includes the determination of the state of the degassing device on the basis of the transport information and on the basis of the negative pressure information.

In an exemplary embodiment of the disclosure, an evaluator for an inkjet printing device, such as an inkjet printer, is described. In an exemplary embodiment of the disclosure, the inkjet printer at least one print head that is supplied with ink from a container. Moreover, the inkjet printer comprises a supply transport pump with which new ink may be transported into the container in order to replace ink that has been consumed by the print head. Furthermore, the inkjet printer comprises a degassing device, wherein ink is transported by means of a degassing transport pump from the container, through the degassing device, and back again into the container.

The evaluator is configured to determine transport information with regard to the transport of new ink into the container. In an exemplary embodiment, the evaluator is also configured to determine negative pressure information with regard to a negative pressure in the degassing device, which negative pressure is produced for degassing of ink. Moreover, in an exemplary embodiment, the evaluator is configured to determine a state of the degassing device on the basis of the transport information and on the basis of the negative pressure information.

Figure 1:
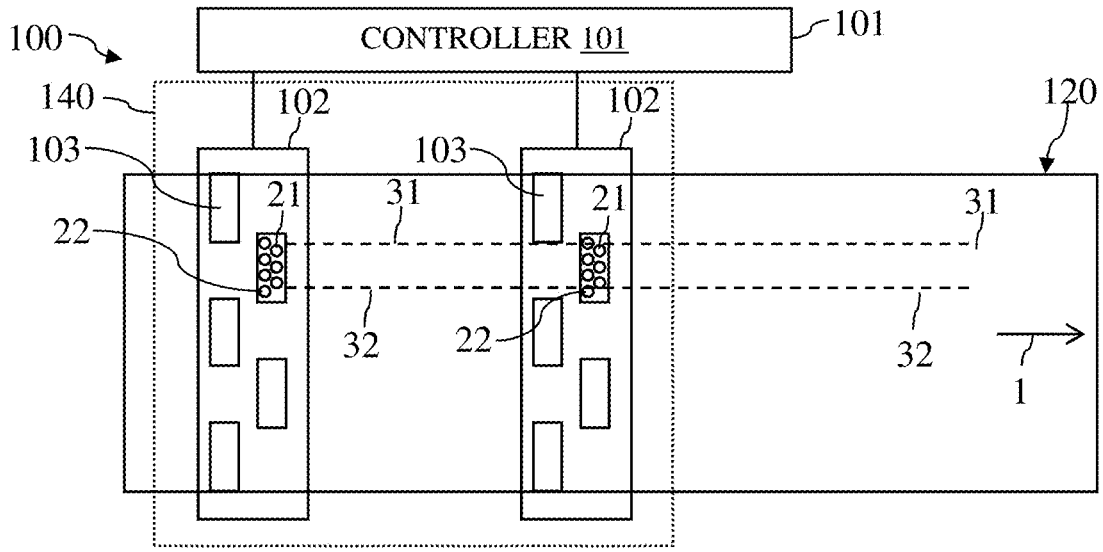
FIG. 1 illustrates a block diagram of an inkjet printer according to an exemplary embodiment of the present disclosure.

FIG. 1 illustrates a printer 100 according to an exemplary embodiment of the present disclosure. In an exemplary embodiment, the printer 100 is configured for printing to a recording medium 120 in the form of a web. This is also referred to as a "continuous feed," since the recording medium 120 is supplied continuously to the printer 100, for example from a roll. The recording medium 120 may be produced from paper, paperboard, cardboard, metal, plastic, textiles, a combination thereof, and/or other materials that are suitable and can be printed to. The recording medium 120 is typically taken off a roll (what is known as the take-off) and then supplied to the print group 140 of the printing system 100. A print image is applied onto the recording medium 120 by the print group 140, and the printed recording medium 120 is taken up again on an additional roll (what is known as the take-up), possibly after fixing of the print image. Alternatively, the recording medium 120 that is printed to may be cut into sheets or individual pages by a cutting device. In FIG. 1, the transport direction 1 of the recording medium 120 is represented by an arrow. One or more of the embodiments of this disclosure are also applicable to a printer 100 configured for printing to recording media 120 in the form of sheets or pages.

In an exemplary embodiment, the print group 140 of the printing system (printer) 100 comprises multiple print bars 102 that may respectively be used for printing with ink of different colors, for example black, cyan, magenta and/or yellow, and possibly MICR ink In an exemplary embodiment, a print bar 102 includes one or more print heads 103 that are possibly arranged next to one another in multiple rows in order to print the dots of different columns 31, 32 of a print image onto the recording medium 120. In an exemplary embodiment, a print bar 102 comprises five print heads 103, wherein each print head 103 prints the dots of one group of columns 31, 32 of a print image onto the recording medium 120.

In an exemplary embodiment, each print head 103 of the print group 140 comprises multiple nozzles 21, 22, wherein each nozzle 21, 22 is configured to fire or push ink droplets onto the recording medium 120. A print head 103 of the print group 140 may, for example, comprise 2558, 5116, or more effectively used nozzles 21, 22 that are arranged along one or more rows transversal to the transport direction 1 of the recording medium 120. The nozzles 21, 22 in the individual rows may be arranged offset from one another. Dots of a part of a line of a print image may be printed onto the recording medium 120, transversal to the transport direction 1 (meaning along the width of the recording medium 120), by means of the nozzles 21, 22 of a print head 103 of the print group 140.

In an exemplary embodiment, the printer 100 additionally comprises a controller 101, for example an activation hardware, that is configured to activate the actuators of the individual nozzles 21, 22 of the individual print heads 103 of the print group 140 in order to apply the print image onto the recording medium 120 depending on print data. In an exemplary embodiment, the controller 101 includes processor circuitry that is configured to activate the actuators of the individual nozzles 21, 22 based on print data.

Figure 2:
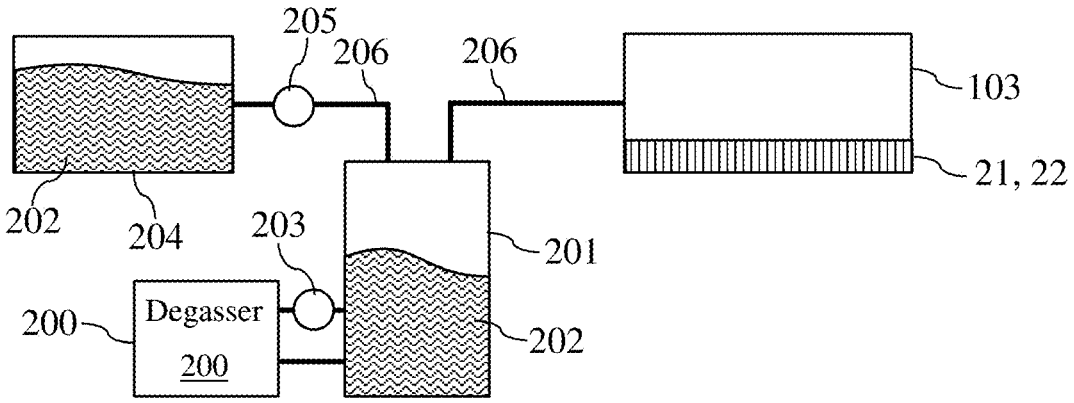
FIG. 2 illustrates an example of an ink supply of a print head of an inkjet printer according to an exemplary embodiment of the present disclosure.

FIG. 2 illustrates the ink supply of a print head 103 according to an exemplary embodiment. In an exemplary embodiment, the one or more print heads 103 of a print bar 102 may be supplied with ink 202 of a specific ink type, for example a specific color, with the ink supply depicted in FIG. 2. The ink supply depicted in FIG. 2 may respectively be provided for each print bar 102 and/or for each ink type of a printer 100 that is used.

In an exemplary embodiment, the ink 202 may be supplied to the individual nozzles 21, 22 of a print head 103 via an ink supply channel 206. The ink supply channel 206 may thereby obtain the ink 202 from a negative pressure or backpressure container 201. The negative pressure container 201 may in turn be supplied with ink 202 from a supply container 204 via an ink supply channel 206. The ink 202 may thereby be transported from the supply container 201 into the negative pressure container 201 by means of a supply transport pump 205. The negative pressure container 201 may be used to set a defined physical negative pressure within the individual nozzles 21, 22 of the print head 103. In an exemplary embodiment, via this negative pressure, it may be ensured that an ink meniscus forms at the exit of a nozzle 21, 22, which ink meniscus may be set into motion by an actuator of the nozzle 21, 22, for example by a piezoelectric actuator, in order to push an ink droplet out of the nozzle 21, 22. The physical (negative) pressure in the nozzles 21, 22 of a print head may be set to a printing operation level in a printing phase. The printing operation level may thereby be set mechanically via the height difference between the nozzle plate of the print head 103 and the fill level of the negative pressure container 201. In an exemplary embodiment, to adjust the pressure in the nozzles 21, 22 to a specific printing operation level, the fill level of the negative pressure container 201 may be adjusted, in particular regulated, to a defined fill level value.

In an exemplary embodiment, the ink 202 provided via the ink supply channel may in advance travel through a degassing device 200 to reduce the gas content of the ink 202. In particular, ink 202 may be pumped by means of a degassing transport pump 203 from the negative pressure container 201, through the degassing device 200, and back again into the negative pressure container 201. The gas content of the ink 202 within the negative pressure container 201, and thus the gas content of the ink 202 provided to the print head 103, may thus be reduced.

Figure 3:
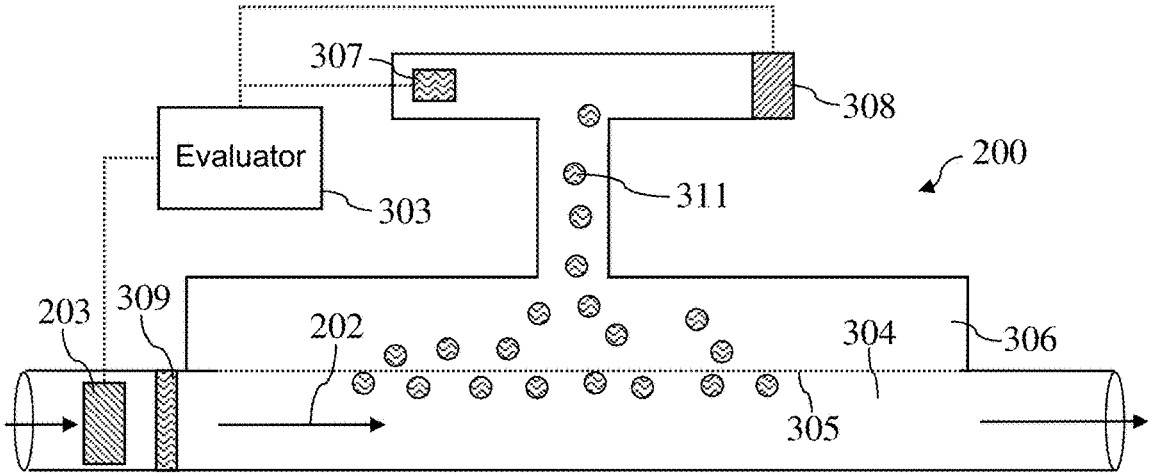
FIG. 3 illustrates an example of a degassing device according to an exemplary embodiment of the present disclosure.

FIG. 3 illustrates a degassing device (e.g. degasser) 200 according to an exemplary embodiment of the present disclosure. The ink 202, represented by the arrows in FIG. 3, thereby travels through an ink channel 304 that is separated from a negative pressure region 306 by a separating element 305, for example by a membrane. The separating element 305 is designed such that gas 311, in particular oxygen, nitrogen, and/or carbon dioxide, may pass across the separating element 305 from the ink channel 304 into the negative pressure region 306, but ink 202 in the ink channel 304 is retained. The ink 202 may be transported by means of the degassing transport pump 203 with a defined volumetric flow rate, or with a defined flow rate through the ink channel 304 of the degassing device 200. The quantity of ink 202 that flows per time unit through the ink channel 304 may thus be set by the degassing transport pump 203. In an exemplary embodiment, the degassing device (e.g. degasser) 200 includes processor circuitry that is configured to perform one or more operations and/or functions of the degassing device 200, including degassing ink.

In an exemplary embodiment, the degassing device 200 includes a negative pressure pump 308 that is configured to generate a negative pressure in the negative pressure region 306 relative to the pressure in the ink channel 304, for example a negative pressure of 0.8 bar. In an exemplary embodiment, the negative pressure has the effect that gas 311 is drawn from the ink 202 in the ink channel 304 into the negative pressure region 306. Via the negative pressure, the gas content of the ink 22 may thus be reduced, or the degree of degassing of the ink 202 may be increased.

The gas content of the ink 202 may, for example, indicate the volume of gas 311 relative to the total volume of the ink 202. At a defined temperature, ink 202 may typically absorb a defined maximum amount of one or more gases 311, for example oxygen, nitrogen, carbon dioxide etc. The degree of degassing of the ink 202 may indicate what proportion of this maximum amount could be removed from the ink 202, or which proportion of this maximum amount is still contained in the ink 202. For example, a degree of degassing of 0% may indicate that the ink 202 has the maximum quantity of one or more gases 311. On the other hand, a degree of degassing of 100% may indicate that the ink 202 no longer contains gases.

In an exemplary embodiment, the degassing of ink 202 thus takes place via a vacuum printer pump 308 that is connected to the negative pressure region 306 of a degassing device 200, in particular of a degassing cartridge. In the degassing device 200, in an exemplary embodiment, the ink 202 is directed along a semipermeable membrane 305, given which the ink 202 flows on the one side, i.e. in the ink channel 304, and given which a negative pressure a negative pressure is applied on the other side, meaning in the negative pressure region 306. In the event that the membrane 305 and/or a filter 309 in the degassing device 200 are clogged, it may no longer be ensured that the ink 202 is degassed.

In an exemplary embodiment, given use of ink 202 that is not degassed, or is not sufficiently degassed, within a print head 103, nozzle failures may occur due to air inclusions in the print head 103, and therefore a reduced print quality may occur. In aspects of the present disclosure, measures are described to efficiently and reliably detect a clogged (ink) filter and/or a clogged membrane 305 in a degassing device 200. The cycles for the exchanging of degassing devices 200 may thus be extended. Furthermore, nozzle failures may thus be avoided, and the print quality of a printer 100 may be increased.

FIG. 4*a* shows a time curve 410 of the negative pressure in a degassing device 200 according to an exemplary embodiment. A decreasing negative pressure thereby approaches the pressure within the ink channel 304. On the other hand, the pressure difference between the ink channel 304 and the negative pressure region 306 is increased in magnitude by increasing the negative pressure.

If gas 311 passes from the ink 202 into the negative pressure region 406, the negative pressure typically decreases. The negative pressure in the negative pressure region 306 may be detected by the pressure sensor 307. As soon as the negative pressure reaches or falls below a lower negative pressure threshold 401, the negative pressure pump 308 is typically activated in order to build up the negative pressure in the negative pressure region 306 again. Upon reaching or exceeding an upper negative pressure threshold 402, the negative pressure pump 308 may be deactivated again. It may thus be achieved that the negative pressure within the negative pressure region 306 lies between the negative pressure thresholds 401, 402. The lower negative pressure threshold 401 may be defined such that, given a correctly functioning separating element 305, a reliably degassing of ink 202 to a defined gas content is enabled as of the negative pressure threshold 401. The upper negative pressure threshold 402 may be defined such that no damage to the separating element 305 is to be expected up to the upper negative pressure threshold 402.

FIG. 4*a* shows a curve 410 of the negative pressure in the event that a substantial quantity of gas 311 is drawn through the separating element 305, into the negative pressure region 306, within a defined time period. As a result of this, the duration 411 between the deactivation of the negative pressure pump 308 (which, for example, takes place upon reaching the upper negative pressure threshold 402) and the directly following activation of the negative pressure pump 308 (which, for example, takes place upon reaching the lower negative pressure threshold 401) is relatively short. The duration 411 is thus an indicator of the quantity of gas 311 that is extracted from the ink 202 within a degassing device 200. In particular, given knowledge of the volumetric flow of the ink 202 through the ink channel 304 and given knowledge of the gas content of the ink at the input of the degassing device 200, after passage through the degassing device 200 the gas content of the ink 202 may be concluded from the duration 411.

FIG. 4*b* shows a curve 420 of the negative pressure according to an exemplary embodiment in the event that no substantial quantity of gas 311 is drawn through the separating element 305, into the negative pressure region 306, within a defined time period. As a result of this, the negative pressure decreases only relatively slowly, if at all. As a result of this, the duration 411 between the deactivation and the subsequent activation of the negative pressure pump 308 is also relatively long in such an instance. It is possible that no activation of the negative pressure pump 308 takes place at all over a longer period of time.

If, in running printing operation, ink 202 with a relatively high gas content is transported by the supply transport pump 204 from the supply container 206 into the negative pressure container 201, and if ink 202 is transported by the degassing transport pump 203 from the negative pressure container 201 through the ink channel 304 of the degassing device 200, then the negative pressure in the degassing device 200 should exhibit the time curve 410 from FIG. 4*a*, since the negative pressure container 201 has ink 202 with a relatively high gas content from the supply container 204. If the negative pressure in the degassing device 200 nevertheless exhibits the time curve 420 from FIG. 4*b*, this is thus an indicator that an (ink) filter 309 of the degassing device 200 is clogged, and thus that no or too little ink 202 is transported through the ink channel 304, and/or that the separating element 305 of the degassing device 200 is clogged, and thus no fraction or only a small fraction of gas 311 may pass from the ink 202 into the negative pressure region 306. The time curve 410, 420 of the negative pressure into the negative pressure region 306 of the degassing device 200, and/or the duration 411 between the deactivation and the subsequent activation of the negative pressure pump 308, are thus a reliable indicator of the state of the degassing device 200.

In an exemplary embodiment, the fill level of ink 202 in the negative pressure container 201 is typically monitored, and ink 202 is automatically resupplied from the supply container 204 as needed. In particular, the fill level of ink 202 in the negative pressure container 201 may be regulated to a defined value or to a defined fill level interval, for example in order to adjust the pressure in the nozzles 21, 22 of a print head 103 to a defined printing operation level. The transport rates of the ink 202 transported from the supply container 204 are thereby typically known and/or can be determined. The quantity of transported ink 202 typically depends on the print image to be printed, and/or on the frequency of cleaning cycles of a print head 103.

In an exemplary embodiment, the negative pressure within the degassing device 200 is detected by a pressure sensor 307. In an exemplary embodiment, given a correctly functioning degassing device 200, the negative pressure should drop during the degassing—as depicted in FIG. 4*a*—since the ink 202 from the supply container 204 has a higher gas content than the already degassed ink 202 in the negative pressure container 201. In an exemplary embodiment, the negative pressure pump 308 typically attempts to compensate for this drop in the negative pressure, and if applicable regulates the negative pressure to a desired value or a defined negative pressure interval. Depending on the ink 202 consumed, fresh ink 202 with higher gas concentration is thus directed through the degassing device 200. The negative pressure pump 308 must then readjust the negative pressure depending on the quantity of the gas 311 dissolved within the ink 202. Given a correctly functioning degassing device 200, the frequency of the degassing cycles, meaning the frequency of the activation of the negative pressure pump 308, thus depends directly on the quantity of ink 202 that is transported from the supply container 204 into the negative pressure container 201. The more frequently and/or the more that ink 202 is transported, the more strongly that the negative pressure declines, and the more frequently that the negative pressure pump 308 must be activated. That is illustrated by the time curve 410 in FIG. 4*a*.

If ink 202 is resupplied from the supply container 204 into the negative pressure container 201, but the negative pressure in the negative pressure region 306 of the degassing device 200 does not significantly drop, it may thus be assumed that the degassing device 200 has an error state and that the ink 202 in the negative pressure container 201 has not been sufficiently degassed. FIG. 4*b* shows a curve 420 of the negative pressure in such an instance.

The function of a degassing device 200 may thus be monitored in that a check is made as to whether the negative pressure in the degassing device 200 drops or not during and/or after a degassing cycle. Within the scope of a method, a check may be made as to whether the negative pressure drops after or upon degassing. In the event that the negative pressure does not drop, a notification may be output via a user interface of the printer 100, for example, which notification indicates that the degassing device 200 is faulty. Within the scope of the method, it may in particular be checked whether ink 202 is resupplied into the negative pressure container 201. Furthermore, a check may be made as to whether ink 202 is transported through the degassing device 200. It may then be checked whether the negative pressure drops or not within the degassing device 200. Given a falling negative pressure, the negative pressure may be built up again via activation of the negative pressure pump 308. If the negative pressure does not drop, an error message may be output.

FIG. 5 shows a flow chart of a method 500 for determining the state of a degassing device (e.g. degasser 200) according to an exemplary embodiment. In an aspect, the degasser 200 is configured to degas ink 202 for the print head 103 of an inkjet printer 100. In an exemplary embodiment, to degas ink 202, ink 202 is transported from a container 201, in particular from a negative pressure or backpressure container 201, through the degassing device 200, and back again into the container 201. In an exemplary embodiment, the printer 100 includes at least one degassing transport pump 203 with which ink 202 is transported through the degassing device 200, in particular through an ink channel 204 of the degassing device 200. The gas content of the ink 202 within the container 201 may thus be reduced. The ink 202 from the container 201 may then be supplied to a print head 103 in order to print a print image onto a recording medium 120 by means of the ink 202. The ink 202 may thereby be drawn from the container 201 by the actuators of the nozzles 21, 22 of the print head 103.

Consequently, the quantity of ink 202 within the container 201 is reduced during the printing operation of a printer 100, meaning that the fill level of the container 201 decreases. To compensate for the consumed quantity of ink 202, new ink 202 may be transported into the container 201 depending on the consumption of ink 202 at the print head 103. The new ink 202 may thereby be transported by a supply transport pump 205, in particular from a supply container 204. The supply transport pump 205 may thereby be operated such that the ink fill level within the (negative pressure) container 201 is within a defined fill level interval and/or at a defined desired fill level value.

In an exemplary embodiment, the method 500 includes the determination 501 of transport information with regard to the transport of new ink 202 into the container 201. For example, the transport information may indicate whether new ink 202 is transported into the container 201 or not. In particular, the transport information may indicate whether the supply transport pump 205 for transport of new ink 202 is active or not. Alternatively or additionally, the transport information may indicate the quantity of new ink 202 that is supplied to the container 201 and/or that has been supplied to the container 201 per time unit.

In an exemplary embodiment, the transport information indicates whether there is a need for the degassing of the ink 202 within the container 201 due to the supply of new ink 202. In other words, the transport information may indicate whether the container 201 contains ink 202 with a relatively high quantity of gas 311, due to the supply of new ink 202, such that substantial quantities of gas 311 should be removed from the ink 202 within the degassing device 200. In other words, the transport information may indicate whether the extraction of relatively high quantities of gas 311 is to be expected within the degassing device 200 due to the supply of new ink 202 into the container 201.

In an exemplary embodiment, the method 500 also includes the determination 502 of negative pressure information with regard to the negative pressure in the degassing device 200 that is produced to degas ink 202. The negative pressure information may thereby indicate the quantity of gas 311 that was extracted from the ink 202 within the degassing device 200.

The degassing device 200 typically has a negative pressure region 306 for receiving gas 311 from ink 202 that is directed through the degassing device 200. The negative pressure within the negative pressure region 306 thereby typically decreases with increasing quantity of removed gas 311. The negative pressure information may indicate whether and/or how the negative pressure drops in the negative pressure region 306. In particular, the negative pressure information may indicate the time curve 410, 420 of the negative pressure in the negative pressure region 306. The quantity of gas 311 that was removed from the ink 202 may in turn be concluded from the time curve 410, 420 of the negative pressure, in particular from the time gradient of the time curve 410, 420. A high gradient in terms of magnitude thereby indicates a relatively high quantity of gas 311, and a small gradient in terms of magnitude indicates a relatively small quantity of gas 311.

In an exemplary embodiment, the degassing device 200 includes a pressure sensor 307 that is configured to record sensor data with regard to the negative pressure in the negative pressure region 306. The negative pressure information may include the sensor data and/or depend on the sensor data. In particular, the sensor data may indicate the time curve 410, 420 of the negative pressure. Precise negative pressure information may be provided via the consideration of the sensor data of a pressure sensor 307.

The negative pressure in the negative pressure region 306 is typically produced by a negative pressure pump 308. The negative pressure pump 308 may be activated if the negative pressure in the negative pressure region 306 reaches and/or falls below a lower negative pressure threshold 401. Furthermore, the negative pressure pump 308 may be deactivated if the negative pressure in the negative pressure region 306 reaches and/or exceeds an upper negative pressure threshold 402. The negative pressure in the negative pressure region 306 may thus be set and/or adjusted by the negative pressure pump 308 to a defined negative pressure interval. The negative pressure information may then indicate whether and/or how often the negative pressure pump 308 is activated. In particular, the negative pressure information may indicate the duration 411 between a deactivation and a subsequent activation of the negative pressure pump 308. The frequency of the activation of the negative pressure pump 308 is thereby a reliable indicator of the quantity of gas 311 extracted from the ink 202.

Transport information may thus be determined, from which it emerges whether the container 201 contains new ink 202 having a relatively high gas content. Furthermore, negative pressure information may be determined, from which the quantity of gas 311 that is extracted from the ink 202 within the degassing device 200 may be concluded.

In an exemplary embodiment, the method 500 also includes the determination 503 of the state of the degassing device 200 based on the transport information and on the basis of the negative pressure information. In particular, it may thereby be determined whether the degassing device 200 is faulty, for example because the negative pressure information indicates that only a relatively small quantity of gas 311 is extracted although the transport information indicates that the container 201 contains ink 202 having a relatively high gas content. It may thus be checked whether the transport information agrees with the negative pressure information or not. If the transport information contradicts the negative pressure information, it may be concluded that the degassing device 200 is in a faulty state. On the other hand, if the transport information matches the negative pressure information, it may be concluded that the degassing device 200 is in an error-free state. An efficient and reliable determination of the state of a degassing device 200 is thus enabled.

In an exemplary embodiment, the state of the degassing device 200 may include the state of a passive and/or non-electrically operated component of the degassing device 200. In particular, the state of a component of the degassing device 200 that is not directly monitored (for example via electrical lines) may be determined with the method 500.

In an exemplary embodiment, alternatively or additionally, the state of the degassing device 200 may include a state of a component of the degassing device 200 that, for the degassing of ink 202, should be permeable to ink 202 or to gas 311 but that might be at least partially clogged. In particular, the state of a gas-permeable separating element 305 (in particular of a membrane) of the degassing device 200 may be determined using the method 500, wherein the separating element 305 is configured to separate the ink channel 304 for ink 202 from the negative pressure region 306 to take up gas 311 from the ink 202 of the ink channel 304. In an exemplary embodiment, alternatively or additionally, the state of a filter 309 may be determined that is configured to filter ink 202 directed through the degassing device 200. In particular, whether the separating element 305 and/or the filter 309 are at least partially clogged or not may thereby be determined on the basis of the transport information and on the basis of the negative pressure information.

In an exemplary embodiment, the state of one or more passive components of a degassing device 200 that are not directly monitored, for instance a gas-permeable separating element 305, may thus be determined with the method 500 described in this document. In particular, the state—for example the permeability or the degree of permeability—of such passive components may be reliably determined via evaluation of negative pressure information with regard to the negative pressure in the degassing device 200.

The nominal quantity of gas 311 that should be removed or extracted in the degassing device 200, for example per time unit, may be determined on the basis of the transport information. In particular, this may be determined from the quantity of new ink 202 supplied from the container 201, for example per time unit, as well as from information with regard to the (possibly typical) gas content of the new ink 202. Furthermore, the real quantity of gas 311 that has actually been removed or extracted in the degassing device 200, for example per time unit, may be determined on the basis of the negative pressure information. This may in particular be determined from the time curve 410, 420 and/or from the duration 411. The nominal quantity may then be compared with the real quantity in order to determine the state of the degassing device 200. In particular, a degree of permeability of the filter 309 and/or of the separating element 305 may be determined on the basis of the comparison of nominal quantity and real quantity. A precise determination of the state of a component of a degassing device 200 is thus enabled.

In an exemplary embodiment, the method 500 also includes the determination of activation information that indicates whether the degassing device 200 for the degassing of ink 202 from the container 201 is activated, and/or whether the degassing transport pump 203 for transport of ink 202 by the degassing device 200 is activated. Furthermore, the activation information may indicate the quantity of ink 202 or the volumetric flow of the ink 202 that is transported using the degassing transport pump 203 through the ink channel 204 of the degassing device 200. The state of the degassing device 200 may then also be determined on the basis of the activation information. The accuracy of the determined state of the degassing device 200 may thus be increased.

In an exemplary embodiment, the method 500 includes the determination of quantity information with regard to the consumption of ink 202 of the print head 103. The quantity information may thereby be determined on the basis of the print data of the print image that is printed by the print head 103. Furthermore, the frequency of regeneration measures to regenerate the print head 103 may be taken into account. The state of the degassing device 200 may then also be determined on the basis of the quantity information. For example, the nominal quantity of gas 311 that should be extracted from the ink 202 in the degassing device 200 may be determined on the basis of the quantity information. The accuracy of the determined state of the degassing device 200 may be increased via the consideration of quantity information.

In an exemplary embodiment, the degassing of ink 202 from the (negative pressure) container 201 takes place cyclically. For this purpose, the degassing transport pump 203 may be activated for a defined cycle duration in order to transport ink 202 through the degassing device 200 with a defined volumetric flow. After the cycle duration has elapsed, the degassing transport pump 203 may then remain deactivated for a defined pause duration until the next degassing cycle begins. In this instance, the negative pressure information may indicate the real negative pressure in the negative pressure region 206 after the cycle duration has elapsed, meaning at the end of a degassing cycle. The real negative pressure may thereby be compared with a defined nominal negative pressure that should be present after the cycle duration has elapsed if a sufficient quantity of gas 311 were to have been extracted from the ink 202. The state of the degassing device 200 may be precisely determined via comparison of the real negative pressure with the nominal negative pressure.

In an exemplary embodiment, the method 500 also includes the output of a notification via a user interface of the inkjet printer 100. The notification may thereby indicate the determined state of the degassing device 200. In particular, a notification may be output if it has been determined that the degassing device 200 exhibits a faulty state. A measure may then be promptly initiated in order to remedy the faulty state. The stability and the print quality of a printer 100 may thus be increased.

Furthermore, in this document an evaluator 101, 303 for an inkjet printer 100 is described. The inkjet printer 100 comprises at least one print head 103, for example as depicted in conjunction with FIG. 1. The print head 103 is thereby supplied with ink 202 from a container 201. In particular, the print head 103 may be configured to draw ink from the container 201 for the printing operation.

In an exemplary embodiment, the inkjet printer 100 includes a supply transport pump 205 with which new ink 202 may be transported into the container 201 to replace ink 202 that has been consumed by the print head 103. The ink fill level in the container 201 may thereby be set, in particular regulated, to a defined fill level value.

Moreover, in an exemplary embodiment, the inkjet printer 100 includes a degassing device (degasser) 200. In an exemplary embodiment, to degas the ink 202 from the container 201, by a degassing transport pump 203, ink 202 is thereby transported from the container 201 through the degassing device 200 and back again into the container 201.

In an exemplary embodiment, the evaluator 101, 303 is configured to determine transport information with regard to the transport of new ink 202 into the container 201. Moreover, the evaluator 101, 303 is configured to determine negative pressure information with regard to the negative pressure in the degassing device 200, said negative pressure being produced for degassing of ink 202. Furthermore, the evaluator 101, 303 is configured to determine a state of the degassing device 200 on the basis of the transport information and on the basis of the negative pressure information.

In an exemplary embodiment, the inkjet printer 100 includes evaluator 101, 303 according to one or more aspects described herein.

According to exemplary embodiments of the present disclosure, it is determined whether a component that is not directly monitored and/or that is passive within a degassing device 200 (e.g. a filter 309 and/or the separating element 305) is correctly functioning. Advantageously, this determination is reliably and efficiently detected according to embodiments described herein. Furthermore, the stability of a printer 100 may be advantageously increased, and the frequency of service tasks may be reduced, via the described measures. Moreover, nozzle failures may be avoided and the print quality may be increased.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, other structural electronic hardware, or a combination thereof. A processor includes a microprocessor, a digital signal processor (DSP), central processing unit (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 transport direction (of the recording medium)
2 movement direction (of a print bar)

21, 22 nozzle
31, 32 column (of the print image)
100 printing device (e.g. printer)
101 controller
102 print bar
103 print head
120 recording medium
140 print group
200 degassing device
201 (negative pressure) container
202 ink
203 transport pump
204 (storage) container
205 transport pump
206 ink supply channel
303 evaluator of the degassing device
304 ink channel
305 separating element (membrane)
306 negative pressure region
307 pressure sensor
308 negative pressure pump
309 filter
311 gas
401, 402 negative pressure threshold
410, 420 negative pressure curve
411 duration
500 method for determining the state of a degassing device
501-503 method steps

What is claimed is:

1. A method for determining the state of a degassing device for degassing ink that is transported from a container, through the degassing device, and back into the container, the ink being supplied from the container to at least one print head of an inkjet printer and additional ink being transported into the container based on a consumption of ink by the print head, the method comprising:

determining transport information corresponding to the transport of the additional ink into the container;

determining negative pressure information corresponding to a negative pressure in the degassing device, the negative pressure being produced to degas the ink; and determining a state of the degassing device based on the transport information and the negative pressure information.

2. The method according to claim 1, wherein the state of the degassing device comprises:

a state of a passive and/or not electrically operated component of the degassing device;

a state of a component of the degassing device permeable to ink or to gas for the degassing of ink, but that might be at least partially clogged;

a state of a gas-permeable separating element of the degassing device that is configured to separate an ink channel for ink from a negative pressure region to receive gas from the ink of the ink channel; and/or a state of a filter that is configured to filter ink that is directed through the degassing device.

3. The method according to claim 1, wherein the transport information is indicative of:

whether a supply transport pump configured to transport the additional ink into the container is active; and/or a quantity of the additional ink that is supplied to the container.

4. The method according to claim 1, wherein:

the degassing device includes a negative pressure region configured to receive gas from the ink that is directed through the degassing device; and the negative pressure information is indicative of one or more drops in a negative pressure in the negative pressure region.

5. The method according to claim 4, wherein:

the degassing device comprises a pressure sensor that is configured to detect sensor data corresponding to the negative pressure in the negative pressure region; and the negative pressure information includes the sensor data and/or depends on the sensor data; and/or the negative pressure information includes a time curve of the negative pressure.

6. The method according to claim 4, wherein:

the degassing device comprises a pressure sensor that is configured to detect sensor data corresponding to the negative pressure in the negative pressure region; and the negative pressure information includes the sensor data and/or depends on the sensor data.

7. The method according to claim 4, wherein:

the negative pressure in the negative pressure region is produced by a negative pressure pump; and the negative pressure information indicates whether and/or how often the negative pressure pump is activated; and/or the negative pressure information indicates a duration between a deactivation and a subsequent activation of the negative pressure pump.

8. The method according to claim 1, further comprising:

determining activation information that indicates whether the degassing device is activated to degas the ink from the container, and/or whether a degassing transport pump is activated to transport the ink through the degassing device, wherein the state of the degassing device is determined based on the activation information.

9. The method according to claim 1, further comprising:

determining quantity information corresponding to the consumption of ink at the print head, wherein the state of the degassing device is determined based on the quantity information.

10. The method according to claim 1, further comprising:

outputting a notification via a user interface of the inkjet printer, the notification being indicative of the state of the degassing device.

11. A non-transitory computer-readable storage medium with an executable program stored thereon, wherein, when executed, the program instructs a processor to perform the method of claim 1.

12. An evaluator for an inkjet printer having at least one print head that is supplied with ink from a container, a supply transport pump with which additional ink may be transported into the container to replace ink that has been consumed by the at least one print head, a degasser configured to degas the ink transported by a degassing transport pump from the container through the degasser and back into the container, the evaluator being configured to:

determine transport information corresponding to the transport of the additional ink into the container;

determine negative pressure information corresponding to a negative pressure in the degasser, said negative pressure being produced to degas ink; and determine a state of the degasser based on the transport information and the negative pressure information.

13. An inkjet printer, comprising:

a print head configured to print ink provided from an ink reservoir, wherein the ink within ink reservoir is at least partially replenished with new ink as the ink is printed by the print head;

a degasser configured to:

receive at least a portion of the ink from the ink reservoir;

degas the ink transported from the ink reservoir to generate degassed ink; and provide the degassed ink to the ink reservoir; and an evaluator configured to:

determine transport information corresponding to the at least partial replenishment of the ink reservoir with the new ink;

determine pressure information corresponding to a pressure within the degasser that is used to degas ink; and determine a state of the degasser based on the transport information and the pressure information.

14. The inkjet printer according to claim 13, wherein the pressure is a negative pressure.

15. The inkjet printer according to claim 13, wherein the transport information comprises a degree at which the ink reservoir is replenished with the new ink.

* * * * *